United States Patent [19]

Kozima

[11] 4,082,599

[45] Apr. 4, 1978

[54] SPLICING ROLLER DEVICE FOR AUTOMATIC PAPER SPLICING APPARATUS

[75] Inventor: Yasuhiro Kozima, Odawara, Japan

[73] Assignee: Nihon Electronic Industry Co., Ltd., Odawara, Japan

[21] Appl. No.: 686,800

[22] Filed: May 13, 1976

[30] Foreign Application Priority Data

Mar. 11, 1976 Japan ..... 51-25543

[51] Int. Cl.[2] ..... B65H 19/18

[52] U.S. Cl. ..... 156/504; 242/58.3

[58] Field of Search ..... 156/504, 502; 242/58.1, 242/58.3, 58.4, 58.5; 271/34, 275

[56] References Cited

U.S. PATENT DOCUMENTS

| | | | |
|---|---|---|---|
| 1,892,987 | 1/1933 | Kleinschmit | 156/580 |
| 3,634,175 | 1/1972 | Delle Vite | 271/275 |
| 3,895,763 | 7/1975 | Tokuno | 156/504 |

*Primary Examiner*—David Klein
*Assistant Examiner*—William H. Thrower
*Attorney, Agent, or Firm*—Haseltine, Lake & Waters

[57] ABSTRACT

A splicing roller device for use in an automatic paper splicing apparatus. The device comprises at least one splicing roller having an adhesive surface and at least one endless belt arranged to pass around the outer surface of the splicing roller and provided with a non-adhesive surface, whereby smooth automatic splicing of two lengths of crude paper is accomplished thus ensuring continuous supply of crude paper to a processing line without lowering of the line speed.

2 Claims, 5 Drawing Figures

SPLICING ROLLER DEVICE FOR AUTOMATIC PAPER SPLICING APPARATUS

FIELD OF THE INVENTION

This invention relates to a splicing roller device for an automatic paper splicing apparatus which is designed, for example, to effect an automatic paper splicing operation on two lengths of new and preceding crude paper in the process of manufacturing corrugated cardboard sheet by a corrugating machine.

BACKGROUND

Crude paper for a corrugated cardboard corrugater is usually supplied in the form of a coiled crude paper which is continuously fed so that when the coiled paper is practically reeled off, a new crude paper coil is spliced to the preceding crude paper coil while there still exists a suitable amount of crude paper on the preceding coil and in this way new crude paper coils are successively spliced to the preceding one so as to accomplish continuous feeding of crude paper.

The above-mentioned paper splicing operation itself has been mostly accomplished through manual operations by an operator as well as by a splicing roller device which is automatically swung and many different types of method have been used for bringing into contact and splicing the preceding crude paper to a new supply of crude paper. In these conventional methods, particularly one in which an adhesive portion consisting of a double-sided adhesive tape or the like is preliminarily provided at the end of a new crude paper coil and the preceding crude paper is pressed against the adhesive portion of the new crude paper by means of splicing rollers, it has been impossible to expect reliable automatic paper splicing due to the fact that there are many cases where during the said pressing operation by the splicing rollers, the new crude paper is not spliced to the preceding crude paper but it is adhered to and wound around the roller.

SUMMARY OF THE INVENTION

With a view to overcoming the foregoing difficulty, it is an object of the present invention to provide an improved splicing roller device of the above type wherein by pressing a new crude paper against the preceding crude paper by at least one splicing roller, positive splicing can be accomplished without any danger of the new crude paper being wound around the splicing roller, whereby automatic continuous operation is made possible and moreover irrespective of the manner in which crude paper coil was wound, namely, irrespective of whether the crude paper was coiled with its surface on the upper side or under side, smooth automatic paper splicing is accomplished so as to continuously feed crude paper to a corrugating machine line with the desired inside and outside relation.

DESCRIPTION OF THE PREFERRED EMBODIMENTS

The present invention will be described in greater detail with reference to the illustrated embodiment hereunder.

Figure 1:
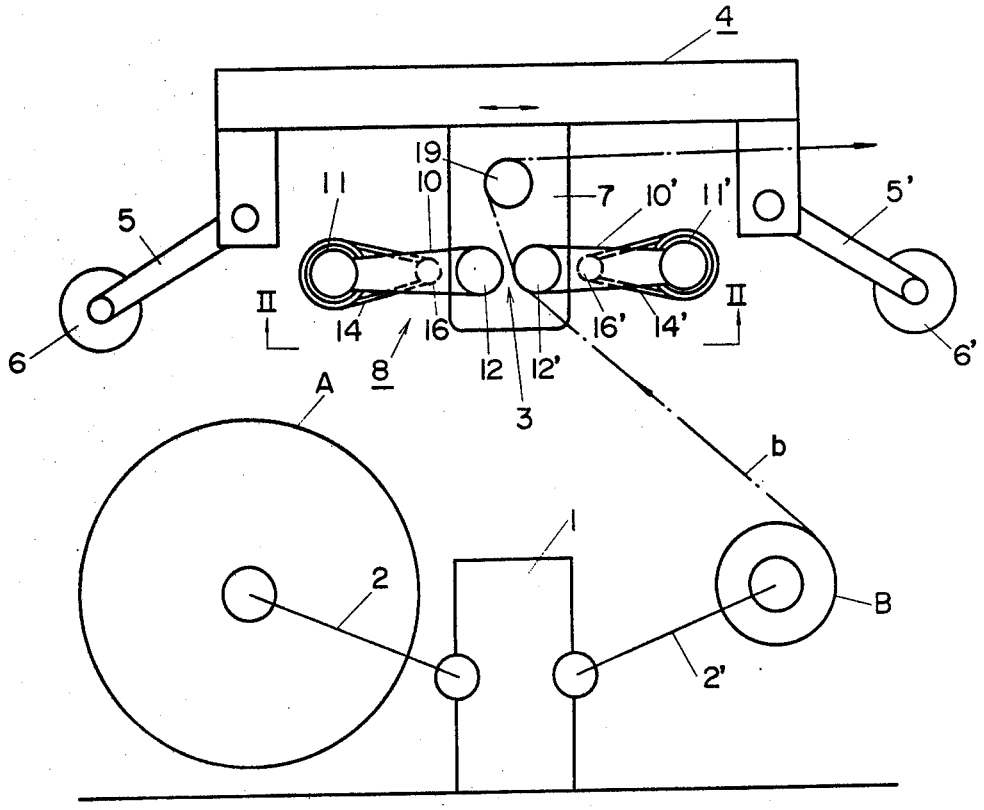
FIG. 1 is a side view showing the general construction of one automatic paper splicing apparatus according to an embodiment of the invention.
Figure 2:
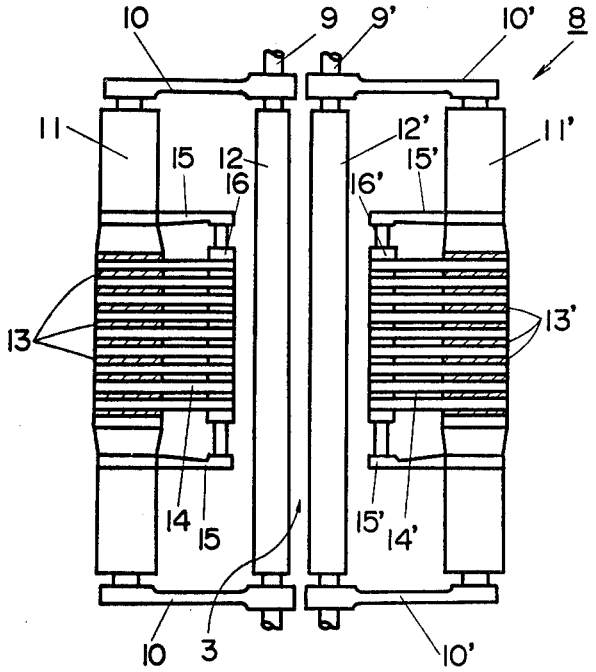
FIG. 2 is a view showing the principal part of the apparatus of FIG. 1 as seen in the direction of line II — II in FIG. 1.

FIG. 1 is an explanatory front view showing an automatic paper splicing apparatus according to an embodiment of the invention as seen from the side of the line, and FIG. 2 is a view showing the splicing roller apparatus constituting the principal part of the apparatus of FIG. 1 as seen in the direction of line II — II in FIG. 1.

In FIG. 1, numeral 1 designates a mill roll stand, 2 and 2' rocker arms so designed that crude paper coils A and B are rotatably mountable on the frame ends thereof and each of the rocker arms is separately rotatable to the desired height by a rotation control unit which is not shown. In the mill roll stand 1, the crude paper coil B feeds the crude paper to a corrugating machine and the new crude paper coil A which is to be spliced to the crude paper coil B is mounted on the rocker arm 2. Prior to its mounting, the terminal end (delivery end) of the crude paper coil A is preliminarily provided with an adhesive portion consisting of a double-sided adhesive tape so that the adhesive surface on the outer side of the coil is adhered to one of a pair of splicing rollers that will be described later and the other adhesive surface on the inner side of the coil which was lightly adhered to the preceding turn of the crude paper is separated from the crude paper and adhered to the crude paper from the coil B to accomplish the desired paper splicing.

In FIG. 1, numeral 4 designates a paper splicing apparatus proper which is arranged above the mill roll stand 1 with a proper positional relation therewith and is provided on the sides thereof with driving rollers 6 and 6' through the intermediary of rotary supporting frames 5 and 5'. The driving rollers 6 and 6' are respectively rotated by a driving motor which is not shown, and the rotary supporting frames 5 and 5' are respectively rotated from a driving source which is not shown so as to swing the rollers 6 and 6'. Thus, a paper splicing operation, the supporting frame 5 on the side of the new crude paper coil A is rotated so that the roller 6 is brought into contact with the coil A and the new crude paper coil A is rotated in a predetermined direction at a predetermined speed through the rotary motion of the roller 6.

Suspended from the paper splicing apparatus proper 4 is a carriage 7 which is movable toward the preceding and new crude paper coils A and B and the carriage 7 is provided with a splicing roller device 8 which is best shown in FIG. 2.

As shown in FIG. 2, the splicing roller device 8 includes rotary arms 10 and 10' which are respectively mounted on rotary shafts 9 and 9' and splicing rollers 11 and 11' are journaled in the forward ends of the rotary arms 10 and 10'. Guide rollers 12 and 12' are respectively mounted on the rotary shafts 9 and 9' and the gap between the guide rollers 12 and 12' forms a gap 3 for passing paper therethrough.

Adhesive portions 13 and 13' which are adhesive to the previously mentioned adhesive tape are formed with material having a smooth surface, such as rubber, on the outer surface of the splicing rollers 11 and 11' in the central portion thereof to extend to a predetermined dimension and endless belts 14 and 14' are passed respectively around the adhesive portions 13 and 13' to divide these adhesive portions in the roll length direction thereof. Each of the endless belts 14 and 14' is made, for example, from a silicone resin-coated material having a roughened outer surface forming a non-adhesive surface which does not adhere to the adhesive tape and consequently the non-adhesive portions and the adhesive portions 13 and 13' are alternately formed on the outer surface of the splicing rollers 11 and 11'.

The endless belts 14 and 14' are also passed around return rollers 16 and 16' which are rotatably mounted respectively on arms 15 and 15' pivotably mounted on the splicing rollers 11 and 11', thus providing tight endless belt means between the associated return rollers and splicing rollers.

The return rollers 16 and 16' are arranged nearer to the guide rollers 12 and 12' than the splicing rollers 11 and 11', namely, the endless belts 14 and 14' extend ahead in the direction of movement of the crude paper delivered from the splicing rollers 11 and 11'.

The rotary arms 10 and 10' as well as the arms 15 and 15', if necessary, are designed to rotate respectively about the shafts 9 and 9' and the rollers 11 and 11' in response to the actuation signals from a driving mechanism which is not shown, and the rotary shafts 9 and 9' constituting the supporting shafts of the rotary arms 10 and 10' are also designed so that the shafts 9 and 9' are tiltable in unison, namely, the plane including these shafts is tiltable relative to the carriage 7.

Figure 3:
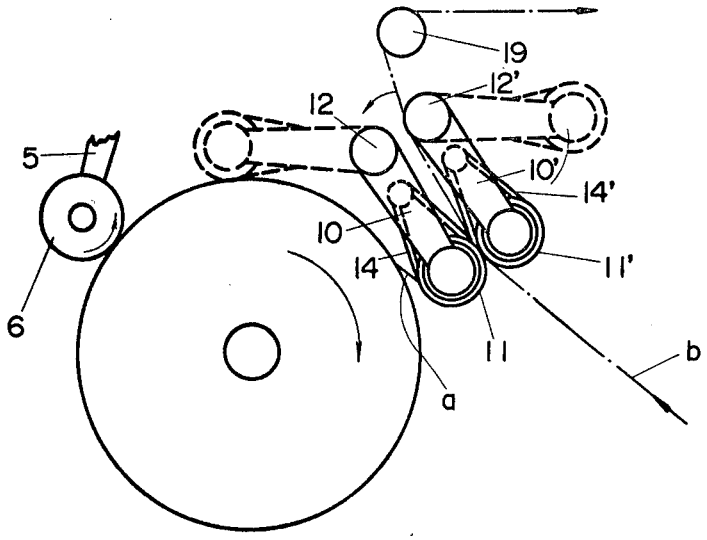
FIG. 3 is an explanatory view showing an exemplary paper splicing operation.
Figure 4:
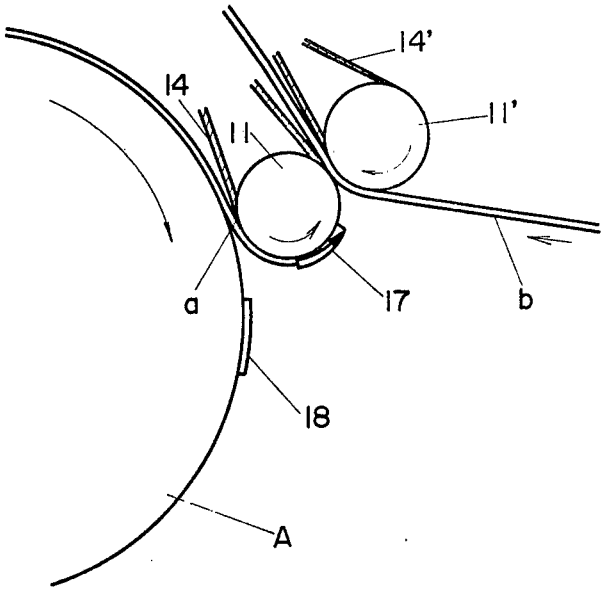
FIG. 4 is an enlarged view of FIG. 3.

Since the splicing roller device for automatic paper splicing apparatus according to the invention is constructed as described above, when it is desired, for example, to deliver new crude paper *a* from the new crude paper coil A and splice it to crude paper *b* being fed as shown in FIG. 3, assuming now that the new crude paper coil A is rotated clockwise to splice the new crude paper *a* in the proper inside and outside relation to the crude paper *b* as shown in FIG. 3, in FIG. 3 the rotary arm 10 is rotated from the broken line position to the solid line position in a direction which closes it and then the carriage 7 is moved bringing its splicing roller 11 into contact with the outer peripheral surface of the new crude paper coil A, after which the driving roller 6 is rotated through the supporting frame 5 into contact with the outer peripheral surface of the new crude paper coil A and at the same time the new crude paper coil A is rotated at a predetermined speed through the rotation of the driving roller 6. When this rotation causes the double-sided adhesive tape 17 at the delivery end of the new crude paper coil A to reach the splicing roller 11 as shown in FIG. 4, the tape 17 is adhered to the adhesive portion of the splicing roller 11 and picked up by the latter and the delivery of the new crude paper *a* from the crude paper coil A is started. That which is shown at reference numeral 18 on the surface of the new crude paper coil A in FIG. 4 is an adhesive tape having a low adhesive surface and used to slightly stick to the inner surface of the double-sided adhesive tape 7 at the delivery end thus preventing the unwinding of the coil and more specifically it may, for example, be an adhesive tape having a large area of its back surface covered with a non-adhesive surface coating to leave a small-area adhesive portion. However, any kind of material may be used provided that it is capable of providing an adhesion between the inner surface of the double-sided adhesive tape 17 and its back surface which is smaller than the adhesion provided between the outer surface of the tape 17 and the splicing roller 11 but sufficient to prevent the unwinding of the new crude paper during its handing for transportion, etc.

During the pickup operation of the new crude paper *a* by the splicing roller 11, the other splicing roller 11' is brought into contact with the splicing roller 11 through the intermediary of the crude paper *b* under a predetermined pressure, with the result that the forward end of the new crude paper *a* being picked up by the splicing roller 11 is inserted, along with the crude paper *b*, between the rollers 11 and 11' by the rotation thereof and the double-sided adhesive tape 17 is attached to the crude paper *b* by virtue of the contact pressure.

As the splicing rollers 11 and 11' are rotated further, the double-sided adhesive tape 17 is also separated from the adhesive portion of the splicing roller 11 by the endless belts 14 and the tape 17 is moved on while being pressed additionally against the crude paper *b* by the endless belts 14 whose outer surfaces are inherently non-adhesive. In this case, by additionally rotating the return rollers 16 and 16' so as to hold the two crude papers therebetween, it is possible to make the pressing of the two crude papers against each other doubly sure, and moreover the endless belts 14 and 14' on the sides may be arranged so that the pitches of their stripe-pattern arrangements in the roll length direction are shifted from each other and the endless belts 14 and 14' mutually fit into the spaces therebetween during the said pressing and in this way the two crude papers may be pressed against each other in the endless belt section, too, thus ensuring more effective adhesion between the crude papers. Thereafter, with its forward end thus adhered to the crude paper *b*, the new crude paper *a* is fed for example to a corrugating machine via a separate guide roller 19 and at the same time the crude paper *b* is cut by a cutter which is not shown thus completing the paper splicing operation.

Figure 5:
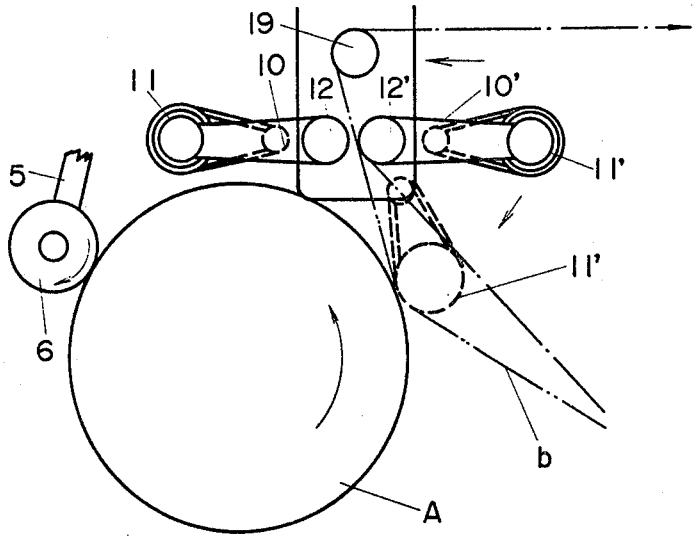
FIG. 5 is an explanatory view showing another exemplary paper splicing operation.

On the other hand, when it is desired to effect paper splicing in a reverse manner to that of FIG. 3 by rotating the new crude paper coil A counterclockwise, for example, the paper splicing can be accomplished by simply pressing the crude paper *b* against the outer peripheral surface of the new crude paper coil A by the other splicing roller 11' alone as shown in FIG. 5 and rotating the coil A through the driving roller 6.

With crude paper coils of the type described above, the manner of coiling crude paper differs by different paper manufacturers, namely, some manufacturers coil crude paper with the surface out, while other manufacturers coil crude paper with the surface placed inside, and consequently during the above-mentioned paper splicing of two coils it often happens that the coils are spliced to each other in a reverse inside and outside relation. This paper splicing with a reverse inside and outside relation is undesirable since it causes variations in the outer appearance and surface profile of the resulting corrugated cardboard produced by the corrugator. With the device of this invention, however, where the operating mode of FIG. 3 or FIG. 5 tends to result in a wrong paper splicing, this may be overcome by accomplishing the paper splicing through an operating mode which is equivalent to that of FIG. 3 or 5 which is seen from the reverse side.

It will thus be seen from the foregoing description that the present invention has a great industrial utility in that since endless belts each having a non-adhesive outer surface are passed around the adhesive outer surfaces of splicing rollers to cover part of the adhesive surfaces, when the double-sided adhesive tape attached to the forward end of a new crude paper coil is picked up by the splicing roller, there is no danger of the adhesive tape being wound around the splicing roller causing failure of the paper splicing, and moreover holding of the two crude papers by the endless belts and the associated members has the effect of effectively accomplishing the adhesion of the tape to the preceding crude paper.

What is claimed is:

1. A splicing roller device for an automatic paper splicing apparatus of the type wherein a splicing roller is rotated in contact with a new crude paper coil to pick up a double-sided adhesive tape attached to the forward end of the new crude paper coil by the adhesion of the tape, and the crude paper picked up from the coil is adhered to another crude paper being fed to a crude paper processing line to thereby accomplish continuous feeding of crude paper, said splicing roller device comprising a plurality of splicing rollers each attached to the forward end of a rotatable arm to be movable toward and away from the outer peripheral surface of said new crude paper coil, a plurality of endless belts passed around the outer peripheral surface of each said splicing roller to extend in the direction of feeding of said another crude paper and having a width dimension corresponding to part of the length of the respective said splicing roller, the surface of each said splicing roller being made of an adhesive surface which is stickable to said tape, the surfaces of said endless belts being made of a non-adhesive surface which is not stickable to said tape, such that said tape is adhered to the surface of one of said splicing rollers is thereafter separated from said splicing roller surface by said endless belts when said splicing roller is rotated further, the surface of the adhesive tape not adhered to said one splicing roller being pressed against said another paper by the surfaces of said rollers and said endless belts, said endless belts being passed around the outer periphery of each said splicing roller such that the outer surface of each said splicing roller is covered in part by said endless belts in a stripe pattern in the length direction of the splicing roller, the length of the splicing roller surface covered by the stripe pattern being longer than the width of the adhesive tape, the width of one endless belt being smaller than the width of the adhesive tape, a return roller for each of said plurality of endless belts arranged downstream of said splicing rollers in the direction of feed of said another crude paper, the return rollers being movable into and out of engagement with each other, the pitch of said stripe pattern in said length direction of each of said splicing rollers being shifted with respect to one other, whereby when said return rollers come into contact with each other, said endless belts on one of said return rollers do not contact said endless belts on the other of said return rollers at the contact surface therebetween.

2. A splicing roller device for an automatic paper splicing apparatus as set forth in claim 1, wherein there are provided a pair of the combinations of said splicing roller and said endless belt, and said splicing rollers are movable toward and away from each other in response to the rotation of said rotatable arms.

* * * * *